US006213303B1

(12) United States Patent
Harris et al.

(10) Patent No.: US 6,213,303 B1
(45) Date of Patent: Apr. 10, 2001

(54) FLUID OR VOLATILE COSMETIC SAMPLER PACKAGE FOR SUBSCRIPTION RATE MAGAZINE INSERTION

(75) Inventors: Michael Harris, Atlanta, GA (US); Manuel Matsos, Baltimore; Lisa Walz, Freeland, both of MD (US)

(73) Assignee: Color Prelude, Inc., Baltimore, MD (US)

( * ) Notice: Subject to any disclaimer, the term of this patent is extended or adjusted under 35 U.S.C. 154(b) by 0 days.

(21) Appl. No.: 09/450,787

(22) Filed: Nov. 30, 1999

(51) Int. Cl.[7] ..... B65D 73/00; B65D 71/40; A45D 40/26; B42D 15/00

(52) U.S. Cl. ..... 206/581; 132/320; 206/232; 206/466; 206/469; 283/56

(58) Field of Search ..... 206/232, 484, 206/529.2, 466, 469, 470, 823, 581; 283/56; 132/320

(56) References Cited

U.S. PATENT DOCUMENTS 4,084,696 * 4/1978 Katz ..... 283/56 X
4,492,306 * 1/1985 Cooper et al. ..... 206/237 X
4,739,778 * 4/1988 Christie ..... 132/320
4,824,143 * 4/1989 Grainger ..... 283/56
4,923,063 * 5/1990 Tararuj ..... 206/484
5,031,647 * 7/1991 Seidler ..... 132/320
5,037,139 * 8/1991 Schoenleber et al. ..... 283/56
5,072,831 * 12/1991 Parrotta et al. ..... 206/232
5,109,879 * 5/1992 Seidler ..... 132/320
5,622,263 * 4/1997 Greenland ..... 206/581
5,918,908 * 7/1999 Barnett et al. ..... 283/56
5,992,889 * 11/1999 Barnett et al. ..... 283/56

* cited by examiner

*Primary Examiner*—Bryon P. Gehman
(74) *Attorney, Agent, or Firm*—Ostrolenk, Faber, Gerb & Soffen, LLP

(57) ABSTRACT

A closed carrier card for packaging a strip of sampler packettes for fluid or volatile cosmetic, beauty, or toiletry products is constructed in a manner suitable for insertion in periodical literature distributable through the U.S. Postal Service and which meets the criteria to be classified under the subscription rate. The closed carrier card is formed by sealing a cover card piece over a portion of a main card piece. The main card has a perforated margin which can be bound within the pages of the periodical literature. A one-way zipper is formed across the cover card piece for exposing a strip of sampler units sealed between the main card piece and the cover card piece. The sampler strip is permanently affixed between the two card pieces at a position such that when the zipper is opened, each of the sampler units become accessible for testing of the product. Each of the sampler packettes has a transparent window placed in alignment with a plurality of cutout windows formed in the carrier card so that the product may be viewed prior to opening. The sampler strip contains a plurality of sampler units of different colors, textures, or types, and is formed by sealing together a transparent composite laminate sealed and a composite laminate having a foil barrier layer to form a pouch for each unit. The transparent composite laminate includes a polymeric barrier layer having a moisture vapor transmission rate substantially similar to that of a foil film.

26 Claims, 7 Drawing Sheets

FLUID OR VOLATILE COSMETIC SAMPLER PACKAGE FOR SUBSCRIPTION RATE MAGAZINE INSERTION

BACKGROUND OF THE INVENTION

1. Field of the Invention

The present invention relates to a product sampler package for presenting a fluid product sampler in a manner which complies with postal regulations for insertion in magazines, catalogs, periodicals, etc. under the subscription or periodicals rate classification for delivery to consumers through the mail system. The product sampler may contain a product having a fluid or volatile base such as water or other organic solvent. Alternatively, the product sampler may be used to provide samples of a powder, wax, or similarly fluid products. Examples of such products include, for example, liquid cosmetics, lotions, creams, gels, fragrances, ointments, etc.

2. Description of the Related Art

Many manufacturers of cosmetics, toiletries, beauty and skincare products, etc. commonly promote their products by distributing free samples or applications to current or potential consumers with the goal of building and/or maintaining customer loyalty for the products or product lines. One method of distributing such samples has been to give them to potential customers in a store in which the product is sold. A further reaching, more effective method has been to mail the sampler packages to a targeted audience through the U.S. Postal Service (USPS). Typically, the samplers are mailed as inserts in brochures, catalogs, magazines, or the like.

For distribution through the USPS, the samplers can be mailed either under a non-discounted rate classification or under a more economical periodical/subscription rate classification. To qualify for classification under the subscription rate, each sampler package must comply with certain guidelines set by the USPS. For example, certain of these guidelines specify that the unit must be firmly affixed to a carrier card or to a page of the periodical, and that the sampler must be designed to allow the product to be tested while still in the periodical.

In addition to the requirements set by the USPS, it is generally desirable that the sampler packages be non-bulky for distribution as inserts and also flexible enough to avoid breakage in shipment or storage yet rigid enough to facilitate high speed insertion into the carrier medium. Further, each sampler unit preferably provides approximately one unit dose of the product in an attractive display having artwork or informational copy print printed thereon while providing a transparent or translucent cover film. A sampler package having these aesthetic features will encourage the potential customer to sample the product and enable the consumer to view the actual product to thereby choose the preferred shade or color prior to opening the package.

The advertising sampler disclosed in Parrotta et al., U.S. Pat. No. 5,072,831 is an example of a prior art package which has been used for cosmetic sampling purposes. A relatively thin paste-like transfer layer of a cosmetic product is coated onto a substrate affixed to a carrier card which can be inserted into magazines and catalogues for mass distribution. The product sample is covered by a transparent protective film which is held in place by a glue strip.

The sampler package of Parrotta is generally suitable for products having a substantially solid or highly viscous consistency such as eyeshadow, pressed powder, and lipstick, as the nature of these products allows for a long shelf life. Specifically, the types of cosmetic preparations listed above are capable of remaining compositionally stable under normal indoor environmental conditions for a relatively long period of time. Therefore, the integrity of such product samples can be readily sustained in such a sampler package until use by a consumer without concern about the materials or sealing methods used.

When the product to be sampled is more fluid and/or volatile such as a liquid or gel, on the other hand, prior art cosmetic samplers such as that of Parrotta fail to provide sufficient product longevity. In designing a sampler package for a fluid or volatile product, it is especially important to seal the package in a manner which prevents leakage and rapid evaporation of the product, and also to include an effective barrier layer in the material containing the product sample to maintain the compositional integrity of the product for the desired shelf-life of the samplers.

Several attempts have been made to produce a better sampler package to retain fluid products, such as those disclosed in U.S. Pat. Nos. 5,391,420 and 5,622,263 to Bootman et al. and Greenland, respectively. These samplers provide hermetically sealed packages which include either a metallized barrier layer such as foil or a polymeric barrier layer such as polyethylene or a PVDC coated film for the distribution of fluid or volatile products.

Foil is known to be the most effective type of flexible barrier film against moisture and vapor transmission. Since the foil layer necessarily renders the package opaque, however, samplers which seal the product in foil laminates are thus most suitable for sampling products such as perfumes or creams, where the color or appearance of the product being sampled does not significantly affect the likelihood of purchase of the product.

On the other hand, the nature of certain cosmetics, e.g. foundation, is such that a consumer will only consider sampling, and subsequently purchasing, the cosmetic if the shade matches her skin tone or the product is otherwise to her liking. With these products, it is especially important that the sampler package provide a means for a consumer to view the product color or texture before actually opening the unit so as to facilitate selection of the appropriate color.

The polymeric barrier layers such as those disclosed in Bootman and Greenland above can be transparent, so that when used to form the package, the actual product can be viewed through the package without opening the package. However, the polyethylene or PVDC coated film of Bootman and Greenland, while more effective than many other known types of transparent films as barriers against moisture and vapor transmission, do not provide a sufficiently long shelf-life for practical distribution of fluid product samples. Since the samplers may be placed in storage or display for a significant amount of time before being distributed to or obtained by a consumer, and may thereafter be set aside for an additional length of time before use, a liquid product sample contained in one of these samplers has a tendency to substantially dry up often before the consumer has an opportunity to sample the product.

Another type of transparent film known to be used as a moisture barrier is a SiOx coating which has a much lower moisture vapor transmission rate than conventional films such as those mentioned previously and including PVDC coated films. Presently, SiOx is commonly used as a coating on PET bottles or containers. This material, however, is similar to a coating of glass, and is too rigid for use in insert-type cosmetic sampler packages which must withstand a certain degree of flexing and bending during handling. When the silane material is folded or flexed, the moisture vapor barrier properties are severely compromised due to fracturing or cracking of the silane coating.

As demonstrated herein, none of the prior art sampler packages allow a consumer to view the actual product through the packaging while maintaining the compositional integrity of a fluid product sample for a satisfactory time period.

SUMMARY OF THE INVENTION

In view of the foregoing discussion, it is therefore desirable to package a product sampler for containing a fluid or volatile product as an insert in periodical literature in a manner which satisfies the requirements for subscription rate classification as set by the U.S. Postal Service.

Furthermore, it is desirable to provide a cosmetic sampler for a fluid or volatile product which overcomes the drawbacks of the prior art noted above. In particular, it is desirable to provide a sampler package, specifically one which allows a consumer to view the shade of the product while preventing the solvent base from evaporating quickly through the sampler material or the sealing points therebetween, and which is flexible enough to avoid breakage in shipment yet rigid enough to permit high speed insertion of package into the carrier medium.

More preferably, it is desirable to provide a product sampler which is relatively flexible and is transparent or translucent, and which also provides moisture vapor barrier qualities on par with that of product samplers which seal the product entirely in foil-containing laminates.

The present invention fulfills each of the desires outlined above by providing a closed carrier card for packaging a strip of sampler units for fluid or volatile cosmetic, beauty, skincare or toiletry products in a manner suitable for insertion in periodical literature distributable through the U.S. Postal Service and which meets the criteria to be classified under the subscription rate. The closed carrier card is formed by adhering a portion of the card onto itself or by adhering a secondary card piece over at least a portion of a main card piece. The main card has a perforated margin which can be bound within the pages of the periodical literature. The carrier card can then be separated from the periodical by tearing along the perforations at the margin.

A one-way zipper is formed by die-cutting across the secondary card piece for exposing a strip of sampler units sealed between the main card piece and the secondary card piece. The sampler strip is permanently affixed between the two card pieces at a position such that when the zipper is unzipped, the sampler units become accessible for testing of the product. Additionally, the secondary card piece overlying the sampler strip includes cutout windows aligned with the placement of the sampler units so that the product may be viewed through the transparent sampler units. The carrier card may also include a coupon which can be easily removed by the consumer for redemption upon purchase of the product.

In a preferred embodiment, the sampler for sampling fluid or volatile cosmetic, beauty, skincare, or toiletry products is formed of a composite laminate having a transparent or translucent nonmetallic barrier layer with a moisture vapor transmission rate (MVTR) substantially equivalent to that of a foil film. Specifically, the barrier film used in the present invention has a moisture vapor transmission rate of less than 0.30 g/100 $in^2$/24 hrs @100 F., 90% RH. Preferably, the barrier film has an MVTR of no greater than about 0.065 g/100 $in^2$/24 hrs @100° F., 90% RH. More preferably, the barrier film has an MVTR between about 0.02 to 0.04 g/100 $in^2$/24 hrs @100° F., 90% RH. Additionally, the film is sufficiently flexible so that it may be flexed without cracking.

One such material which can be used as the nonmetallic barrier layer of the present invention is a biaxially oriented polyvinylidene chloride film which is included in the composite laminate used to form the product sampler. The structure of the biaxially oriented PVDC film provides superior moisture vapor barrier qualities, while also being thermoformable and having a high resistance to heat and humidity.

Another suitable material for the nonmetallic barrier layer is a modified fluoropolymer film, specifically a polychlorotrifluoroethylene film (PCTFE). PCTFE exhibits a moisture vapor transmission rate and other desirable qualities similar to those of the biaxially oriented PVDC.

The barrier layer film is laminated with other layers, such as heat seal layers or layers to enhance strength or durability, to form a composite laminate. Each layer in the composite laminate is transparent or translucent, including the barrier layer film, so as to enable viewing of the color and texture of the product contained therein.

The use of films such as biaxially oriented PVDC and PCTFE to form the barrier layer in a composite laminate advantageously permits the production of a transparent cosmetic product sampler which is capable of maintaining the integrity of a product sample to approximately the same extent as if the product was sealed in an entirely foil based laminate package or in a capped bottle or jar. The composite laminate has a thickness which retains the necessary flexibility to withstand flexing yet provides sufficient rigidity to resist wrinkling or folding when inserted into magazines, catalogs, etc.

Each sampler unit is formed by sealing together a top and a bottom composite laminate to form a pouch in a desired shape including a window through which the product may be viewed. Furthermore, each sampler unit includes a region in which opening of the pouch formed therein is facilitated. In the preferred embodiment, the pouch is shaped to form a tip at an upper region thereof. The unit is perforated along the upper region so that when torn, the pouch can be opened at the tip to enable sampling of the product.

The product sampler of the present invention is suitable for use with cosmetic type products having a solvent base of water and/or other organic solvent, including but not limited to liquid products, creams, gels, lotions, powders, wax-based products, ointments, shampoos, perfumes, fragrances, etc.

Other features and advantages of the present invention will become apparent from the following description of the invention which refers to the accompanying drawings.

DETAILED DESCRIPTION OF THE PREFERRED EMBODIMENTS

Figures 1, 2:
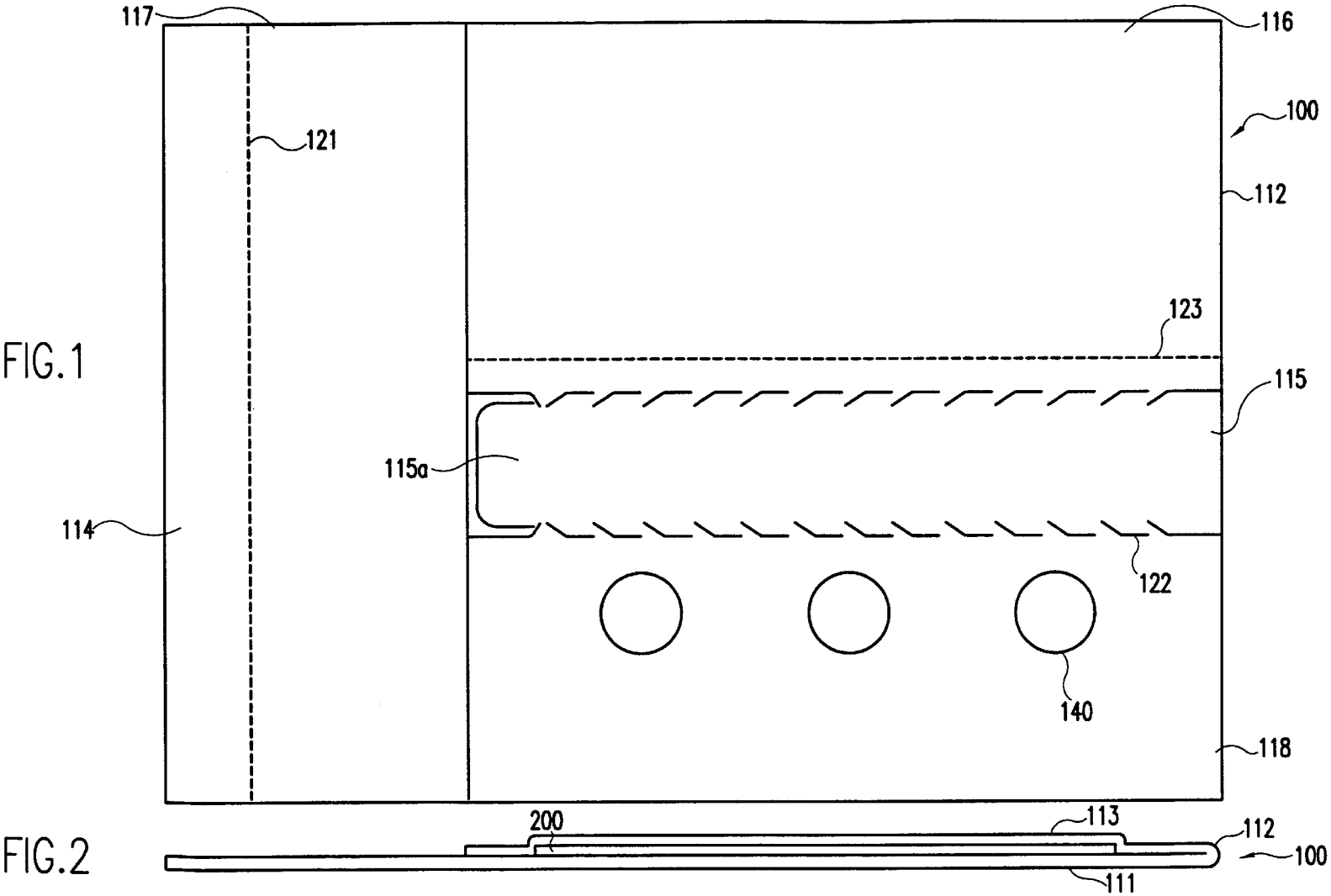
FIG. 1 shows a top view of a closed carrier card suitable for being inserted in a periodical in accordance with the present invention.
FIG. 2 shows a cross sectional view of the closed carrier card enclosing a strip of product sampler units in accordance with the present invention.

A closed carrier card 100 of the present invention for enclosing a sampler strip for fluid and/or volatile cosmetic, beauty, and toiletry products is shown in FIG. 1. As can be seen upon reference to FIGS. 2 and 3, carrier card 100 is constructed from an elongated substrate which includes a main card body 111 plus an extension thereof forming secondary or cover card piece 113. Cover card piece 113 is folded along fold 112 over a portion of the main card 111 so as to form a covering over a corresponding region of main card 111.

Viewed in the longitudinal direction of the figure, main card 111 preferably has a length substantially equal to the width of a page in the periodical in which the carrier card 100 is to be inserted, e.g., approximately 8 inches for a typically-sized magazine. Cover card 113 is shorter in length than main card 111, so that when folded, region 117 of main card 111 as shown in FIG. 1 remains uncovered. In alternative embodiments, the length of cover card 113 can be substantially equal to that of main card 111 including margin region 114, or can be equal to the length of main card 111 from fold 112 to a perforation line 121, described below. The width of main card 111 is generally the same as the width of cover card 113 and can be any width greater than the height of the sampler package but equal to or less than the height of a periodical in which card 100 is inserted, e.g., approximately half the length of a periodical page. The size of the closed region for enclosing a sampler strip within carrier card 100 is thus determined by the length of cover card 113.

Preferably, but not necessarily, fold 112 may be perforated to facilitate detachment of a coupon region 116 and zipper 115 as will be discussed hereinafter. Alternatively, cover card 113 can be a physically separate card piece from main card 111 which is then affixed thereto.

Main card 111 has a perforation 121 formed near the edge opposite fold or edge 112 and extending down the width of the card. A slim margin 114 which is defined between perforation 121 and the edge opposite fold or edge 112 is then available for binding into the pages of a magazine, catalog, brochure, etc. Perforation 121 thus allows the carrier card 100 to be easily separated from the periodical by tearing therealong.

Optionally, perforation 121 may be omitted, whereupon the carrier card 100 can be either loosely inserted into the carrier medium or bound into the carrier medium without a specifically provided means for detachment therefrom.

Cover card piece 113 has a perforated zipper 115 including start tab 115*a* formed thereon at a position approximately half-way down the width of the card. As can be seen in each of FIGS. 1 and 4–6, zipper 115 is preferably a strip having a width of approximately one inch and formed by a plurality of angled cuts 122 die-cut substantially along the length of cover card 113. Of course, other die-cut patterns may be used to define the zipper, such as straight perforations or dots. The width of zipper 115 may be varied within a wide range, but is generally designed to provide access for opening the individual units of sampler strip 200 sealed between main card 111 and cover card 113 as will be described below.

Formed in this manner, zipper 115 can be opened or unzipped by pulling on tab 115*a* so as to tear card 113 along the perforations 122 in the direction toward fold or edge 112. Zipper 115 is thus a one-way zipper which, once opened, cannot be reclosed, although alternative embodiments can be readily envisioned in which a resealable zipper is incorporated into cover card piece 113.

In another alternative, the zipper can be replaced by another means of opening the carrier card, such as a tear strip in which a ribbon, string, or the like is affixed to the bottom surface of the cover card across the portion thereof to be opened, with one end of the ribbon exposed for opening. In this embodiment, the card may be opened by pulling the ribbon, string, or the like to cut or tear open the cover card to thus expose the sampler strip underneath. The cover card may be scored along the length of the ribbon, string, or the like to facilitate tearing when the ribbon is pulled.

Cover card 113 also includes a perforation 123 extending along the length thereof above zipper 115 so as to define a coupon region 116. Copy print such as advertising information or a coupon for the sampled product may be printed on both the front and back surfaces of coupon portion 116 of cover card 113. Perforation 123 and the perforations at fold 112, if provided, allow the consumer to easily separate coupon 116 from the remainder of the carrier card to be redeemed upon purchase of the sampled product.

Windows 140 are formed by die-cutting and punching through cover card 113 in region 118 below zipper 115 at locations corresponding to the placement of each of a plurality of sampler units of sampler strip 200 sealed in carrier card 100 so that at least a portion of each sampler unit can be viewed through cutout windows 140. In the preferred embodiment of sampler strip 200, each sampler unit includes a pouch for containing fluid or volatile cosmetic or beauty products, wherein at least the top laminate forming the pouch has a transparent or translucent window. Thus, a consumer will be able to view the texture and color of the sampled product through the transparent or translucent window exposed through a corresponding cutout window 140.

As with coupon portion 116, the top (exterior) surface of region 118 (surrounding windows 140) can be printed with illustrations, designs, and/or advertising and product information. Unlike coupon portion 116, however, region 118 of cover card 113 is not intended to be separable from main card portion 111, and therefore only the front surface of region 118 need be printed with such designs or information. Similarly, region 117 of main card 111 which is not covered by cover card 113 and also the back surface of main card 111 can be printed with illustrations, designs or text such as advertising information, product description, or instructions for accessing the product sample.

Figure 3:
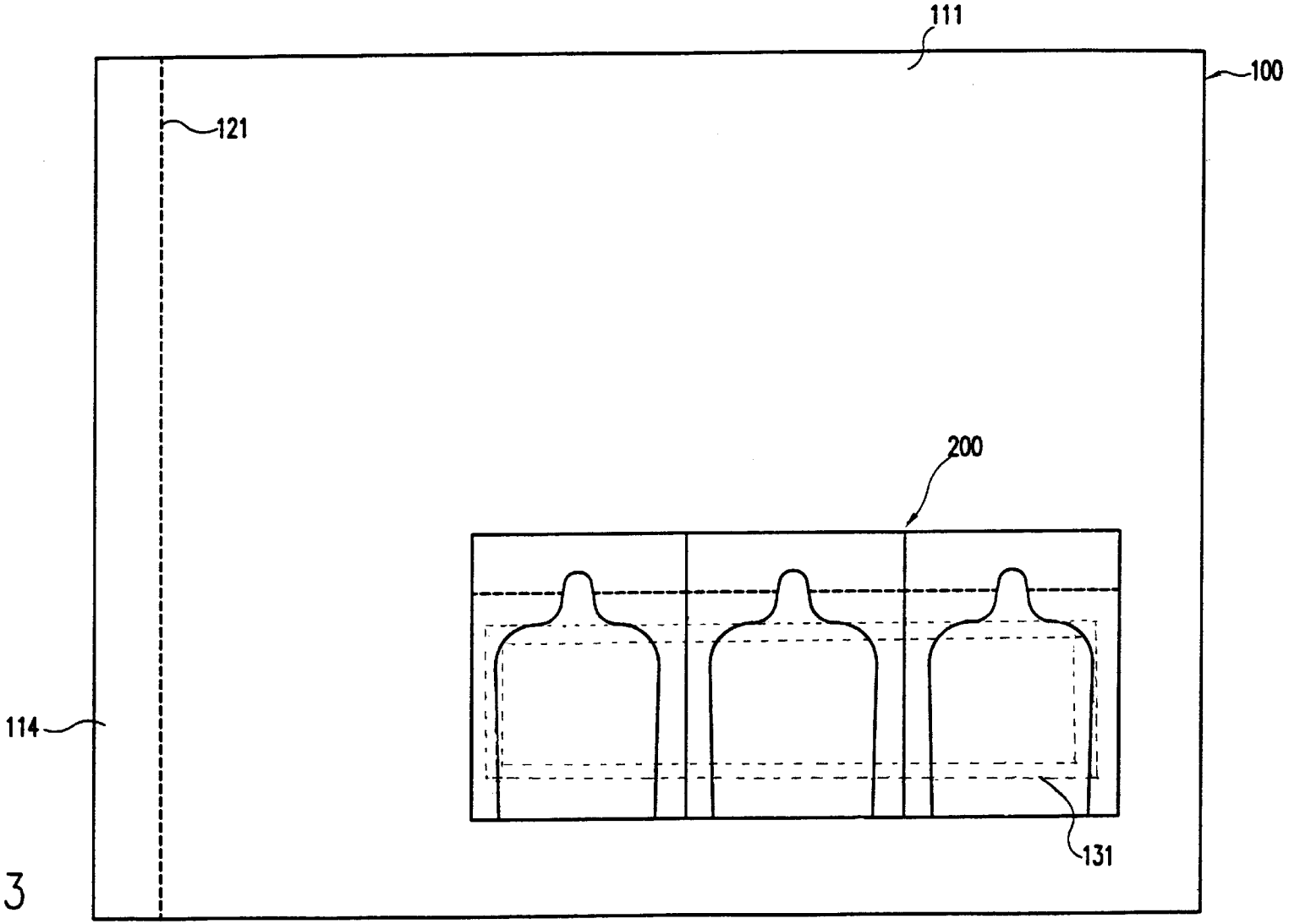
FIG. 3 shows the strip of sampler units adhered to a main card piece of the carrier card.

FIG. 3 illustrates the placement of sampler strip 200 on the surface of main card 111. Specifically, sampler strip 200 is adhered to card 111 at a predetermined position in which the entire strip 200 will be covered by cover card 113. Preferably, sampler strip 200 is positioned on the lower half of main card 111 as shown in the figure. To affix sampler strip 200 to main card 111, an adhesive material is applied either to the main card 111 at the desired location or to the rear surface of sampler strip 200 in a pattern 131 or the like, whereupon sampler strip 200 is affixed to main card 111 with the application of pressure. The adhesive used to secure the sampler strip to the main card is preferably a permanent adhesive such as a hot melt.

Figure 4:
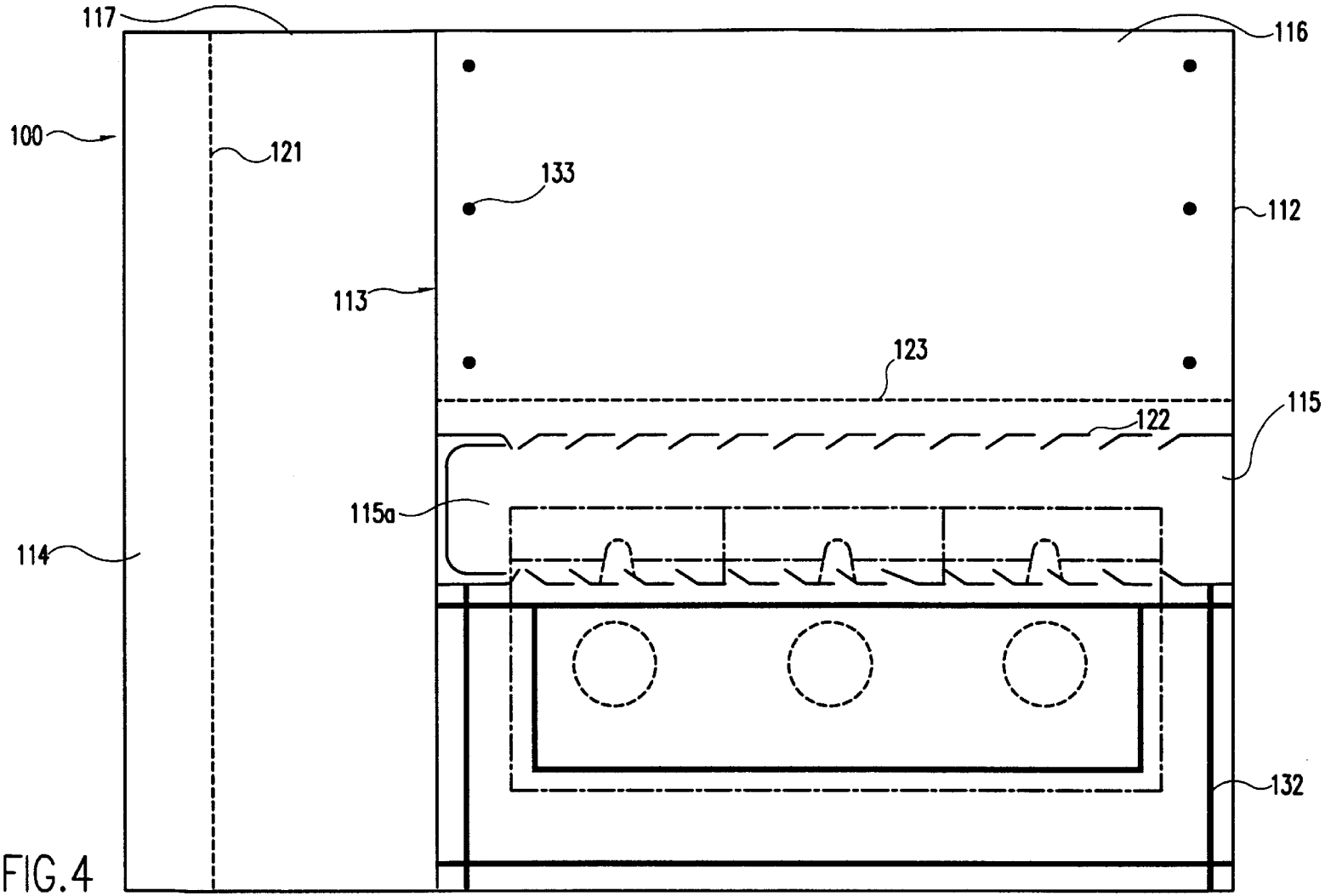
FIG. 4 shows the adhesive patterns sealing a secondary card piece to the main card piece thereof and to the sampler strip.

Prior to folding or superimposing cover card 113 onto main card 111 and sampler strip 200, a permanent adhesive is applied either to the back surface of cover card 113 which faces main card 111 when superimposed or folded thereon or to the corresponding surface of main card 111. In an example shown in FIG. 4, the adhesive is applied in a region corresponding to the placement location of sampler strip 200 in a pattern 132 so as to extend at least across the length of sampler strip 200 and from the lower edge of the card to just below zipper 115 on cover card 113. As shown in the example of FIG. 4, adhesive pattern 132 runs substantially around the perimeter of region 118 below zipper 115 and around windows 140 so that sampler strip 200 can be firmly held in place between main card 111 and cover card 113. Other equally acceptable adhesive configurations for securely sealing the sampler strip 200 inside carrier card 100 will become apparent to those of skill in the art.

Also on the back surface of cover card 113, dots of temporary adhesive 133 are applied around the perimeter of coupon region 116. The temporary adhesive forming dots 133 can be any adhesive, such as a pressure sensitive adhesive or a semi-sticky material, which enables coupon 116 to be easily separated from main card 111 by a consumer without destruction of the coupon or the remainder of the carrier card. One example of a temporary adhesive suitable for this purpose is a water-based acrylic.

On the other hand, the permanent adhesive 132 is such that the lower region 118 cannot be readily separated from main card 111 or sampler strip 200 to remove the strip therefrom without destruction of carrier card 100. As mentioned above, a hot melt adhesive is preferred for the permanent adhesive, although any other type of permanent adhesive known in the art may be suitable for use with the present invention.

After adhesive patterns 132 and 133 have been applied to the respective regions of cover card 113 and once sampler strip 200 is adhered into place on the surface of main card 111, cover card 113 is simply folded along fold line or perforation 112 or is placed over main card portion 111 aligned along the right edges thereof, whereupon the two card pieces are sealed together to form closed carrier card 100.

The substrate material used to form carrier card 100 is preferably a sheet of thin paperboard, although other suitable materials may also be used, such as synthetic paper or a light plastic such as a polyethylene/calcium carbonate blend. The material selected to make carrier card 100 must be sufficiently rigid to facilitate insertion thereof by machines into periodical literature, brochures, etc. On the other hand, the material must be sufficiently flexible so that zipper 115 can be unzipped as described above.

It is emphasized that although the product sampler package described herein is preferably used to package a multi-unit sampler strip for fluid products, the closed carrier card of the present invention can be used with a variety of product samplers not limited to the sampling of fluid products. Moreover, the product sampler used with the present carrier card can have various construction and shapes not necessarily limited to that of the preferred embodiment disclosed herein. In this regard, one of skill in the art can readily contemplate various modifications to the dimensions and/or the placement and structure of the specific features to accommodate a particular product sampler used therewith. Furthermore, certain features, such as the coupon region for example, may be omitted if desired.

Figure 7:
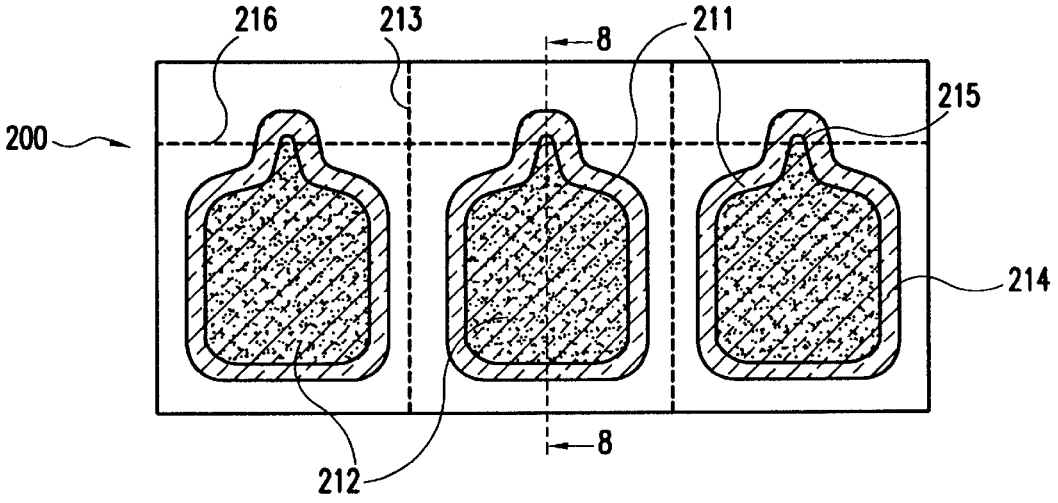
FIG. 7 shows a top view of a preferred embodiment of a sampler strip according to the present invention.
Figure 8:
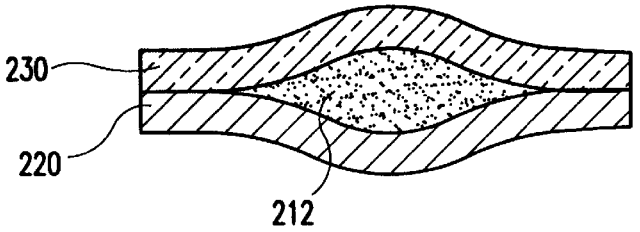
FIG. 8 shows a cross-sectional view of one unit of the sampler strip shown in FIG. 7 taken along the line 8—8.

A preferred embodiment of a sampler strip enclosed within carrier card 100 is illustrated in FIGS. 3 and 7. In this example, sampler strip 200 is a strip containing a plurality of sampler units or packettes formed by laminating together a cover film 230 and a backing film 220 (FIG. 8) to form individual pouches 211. Both the cover film and the backing film are formed as composite laminates each including a barrier film layer having a moisture vapor transmission rate substantially equivalent to that of a foil film. At least the cover film is transparent or translucent, or includes a transparent or translucent window 214 so that the product contained therein can be viewed without opening the sampler.

In the preferred embodiment of the invention, each pouch 211 is formed with a tip 215 at the top portion thereof, to provide a spout-like opening through which the product can be easily dispensed. Perforations 213 and 216 are die-cut into the laminated strip between the individual pouches and across the top portions thereof, to facilitate separation and opening of the sampler units at tip 215.

Once sampler strip 200 is sealed in carrier card 100 as described above and as appears in FIG. 1, the carrier card 100 can then be inserted or bound along margin area 114 within the pages of a periodical or other literature to be distributed to potential clients. Packaged in this manner, the sampler strip is firmly affixed to the carrier card in a manner which permits sampling of the product while affixed thereto. Of course, carrier card 100 may be distributed as is without being attached to any other carrier medium. As mentioned previously, the consumer can then detach carrier card from the periodical by tearing along perforation 121, although detachment from the periodical is not necessary for sampling the product, as described below.

Figure 5:
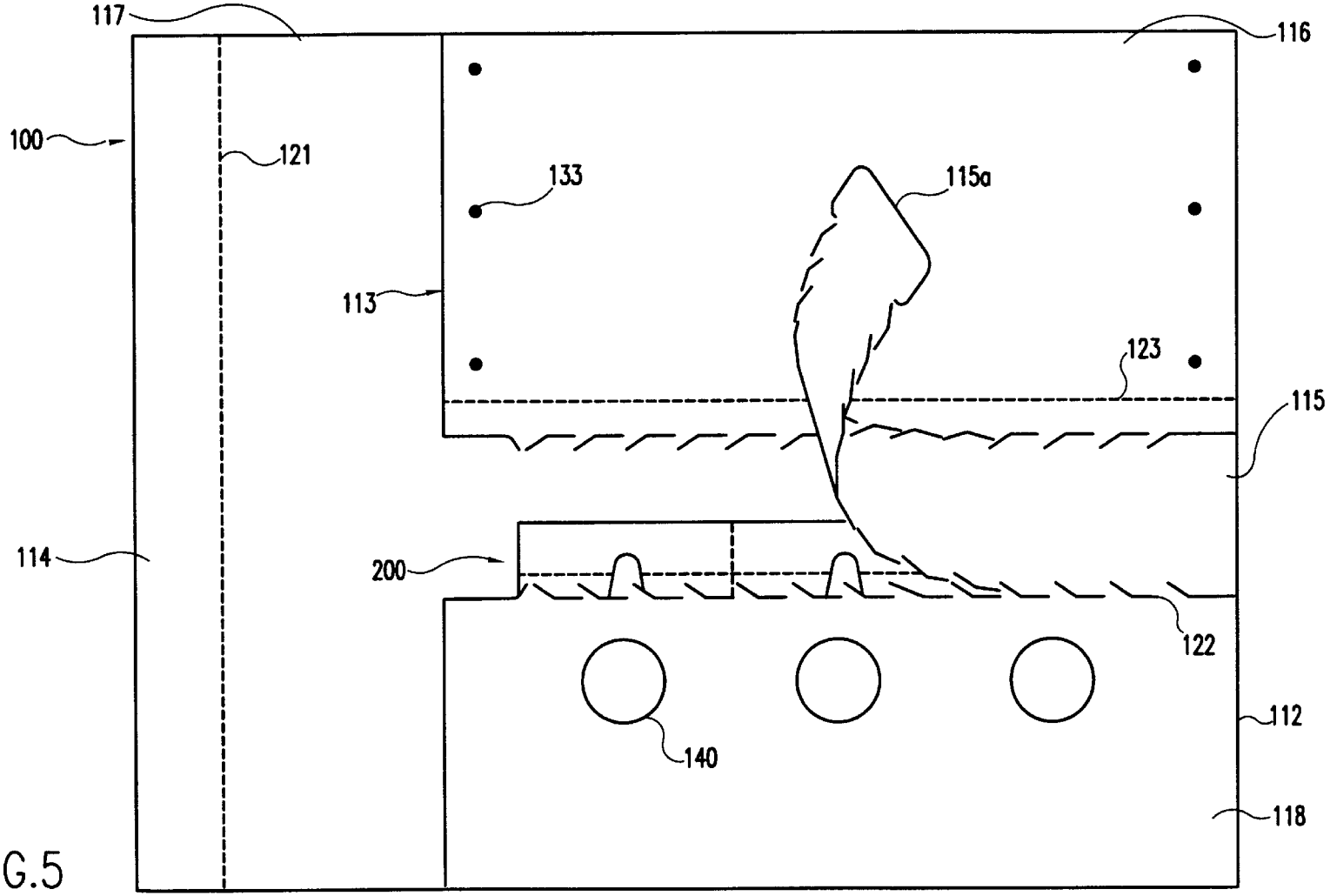
FIG. 5 shows the carrier card in a partially opened state exposing a portion of the sampler strip sealed inside.
Figure 6:
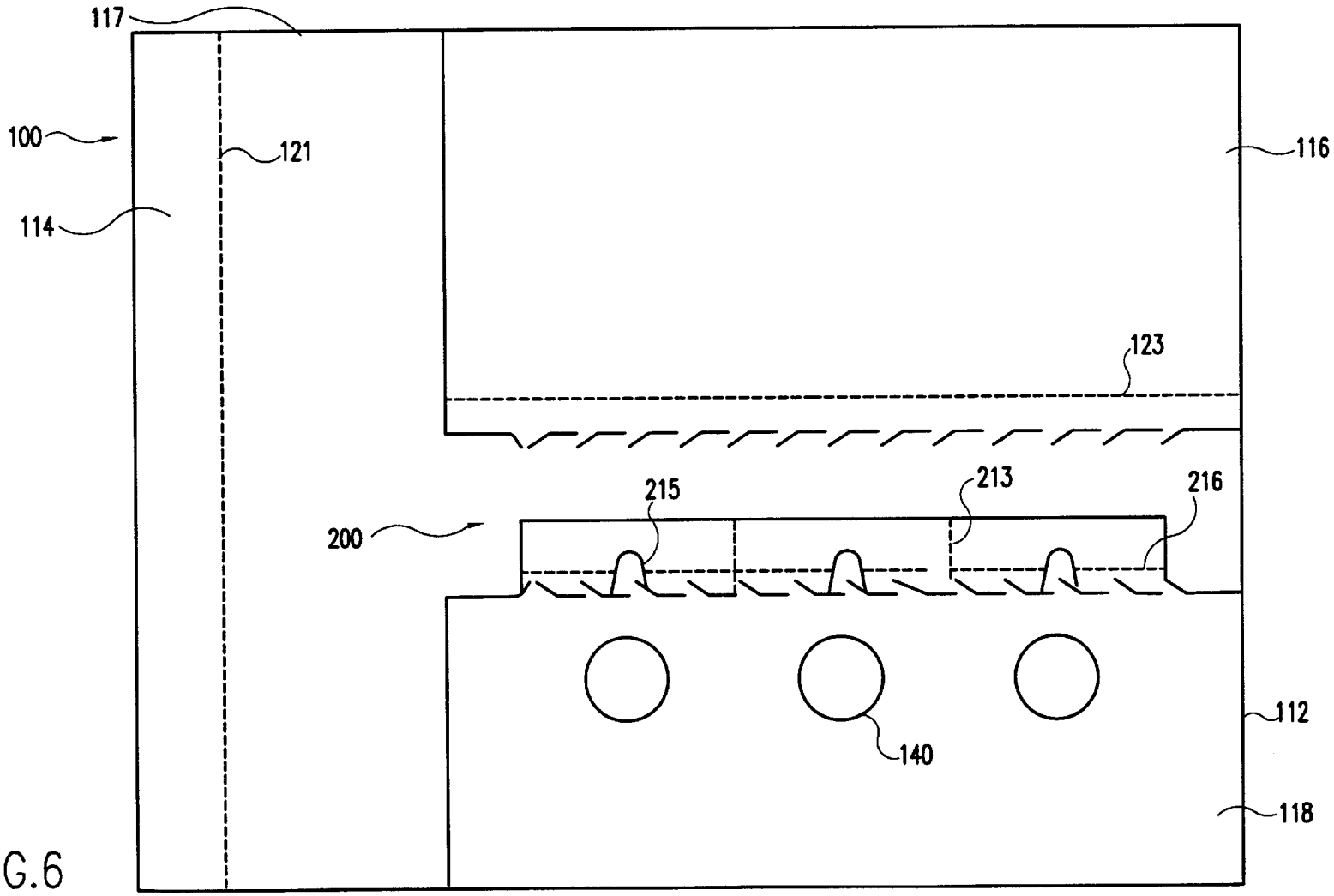
FIG. 6 shows the carrier card in a fully opened state in which the zipper has been pulled open and removed thereby exposing the sampler units for testing.

When the consumer desires to sample the product, the closed carrier card is opened by grasping zipper tab 115*a* and pulling in the direction toward fold or edge 112, thus tearing cover card 113 along perforations 122 as illustrated in FIG. 5. After being pulled completely open, zipper 115 can be neatly detached from the carrier card by tearing along the perforations at fold 112 and discarded. In the embodiment where cover card 113 is provided as a separate piece from main card portion 111, zipper 115 becomes automatically separated from carrier card 100 upon being fully unzipped.

Once zipper 115 is opened, the top portions of the sampler units are exposed, including tip portions 215 and perforations 213 and 216. Upon selecting the desired shade to sample by viewing the choices through cutout windows 140, the selected sampler unit is isolated by tearing down perforations 213 below perforation line 216. The consumer then tears the selected unit open along the appropriate perforation 216. Since the end of tip 215 extends above perforation line 216, tearing of perforation 216 across tip 215 will unseal the corresponding pouch 211 at tip 215. The product is then released from the pouch for application to the consumer's skin simply by squeezing or applying pressure to the main portion of pouch 211 covered underneath cover card region 118.

A more detailed description of the preferred embodiment of sampler strip 200 will now be described with reference to FIGS. 7–11. In the example shown, the product sampler includes three sampler units or packettes. Each sampler unit has a pouch 211 for containing a sample of a volatile and/or liquid based product 212 such as a cosmetic, skincare, beauty, or toiletry product. Each pouch is formed by sealing a transparent or translucent composite laminate forming the cover film 230 (FIG. 8) to an opaque composite laminate forming the backing film 220 of the sampler packette.

Cover film 230 contains a transparent or translucent polymeric barrier film having a moisture vapor transmission rate (MVTR) no greater than about 0.065 g/100 $in^2$/24 hrs @100° F., 90% RH. Preferably, the barrier film has an MVTR substantially competitive with that of a film of aluminum foil and between about 0.02 to 0.04 g/100 $in^2$/24 hrs @100° F., 90% RH.

Suitable materials for the moisture vapor barrier layer include a biaxially oriented polyvinylidene chloride (biax-PVDC) film, such as BARRIALON®-UB film manufactured by Asahi Chemical Industry, Co., Ltd. and distributed by Phoenix Films, Inc., or a modified fluoropolymer film such as a polychlorotrifluoroethylene (PCTFE) film familiar to those knowledgeable in the art as ACLAR®, manufactured by Allied Signal Corp. Both the biax-PVDC film and the PCTFE film have MVTR values within the desired range and are also transparent.

Figure 9A:
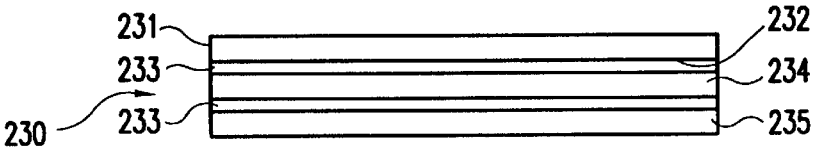
FIG. 9A shows a schematic view of the layers forming the transparent composite laminate film used to make the product sampler in accordance with a preferred embodiment of the present invention.

A preferred embodiment of cover film 230 is shown in FIG. 9A and has a thickness of approximately 4.5 to 5.0 mils, with the barrier film preferably having a thickness of up to approximately 2 mils. More preferably, the barrier film is about 1 mil thick in sampler packettes for most products. Cover film 230 additionally includes an exterior layer 231, and a heat seal layer 235 to enable heat sealing of the cover film 230 with the backing film 220 as will be described below.

Exterior layer 231 is preferably made from polyester, while heat seal layer 235 is preferably made from a blend of high density and low density polyethylene. Other suitable transparent or translucent polymeric films may be substituted for exterior layer 231. Similarly, other types of heat seal layers may be used, such as polyester, which is an excellent chemically resistant barrier. Additional layers may also be included in cover film 230 in accordance with various aspects of the present invention, such as additional barrier layers and/or other films to augment the sealing layer. Each layer in cover film 230 is transparent or translucent, so as to provide a sampler package which enables viewing of the color and texture of the product to be sampled.

The various layers of cover film 230 are preferably adhesively laminated together using adhesive layers 233 made of, for example, a polyurethane adhesive. Alternatively, the cover film layers may be coextrusion laminated using tie layers made from materials such as ethylene vinyl acetate, ethylene methacrylate or ethylene vinyl alcohol. As mentioned above, additional layers may be coextruded with the barrier film and may include films made of an oriented polypropylene or linear low density polyethylene.

The plurality of layers in the composite laminate forming cover film 230 further enhances the moisture barrier properties of the foil-like MVTR of the barrier film. Moreover, the composite laminate is stiff enough to provide sufficient rigidity to resist wrinkling or folding during handling, yet retains the necessary flexibility to withstand flexing without cracking or otherwise compromising its barrier qualities.

In order to define a window through which the product sample is viewed, a window design 214 and/or copy print may be printed onto either the exterior surface of the top layer 231 using any known method of printing onto a film, or onto the interior surface thereof by reverse surface printing prior to lamination with the barrier film 234.

Figure 9B:
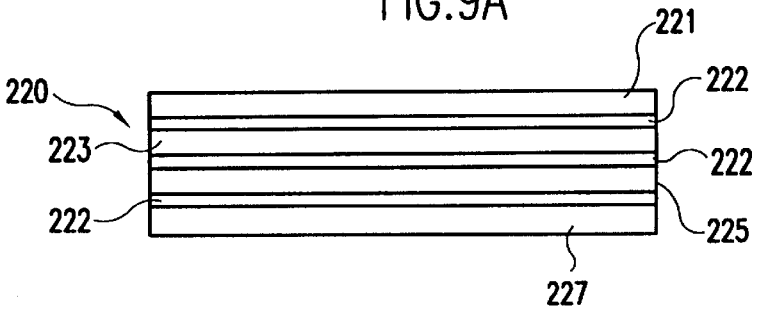
FIG. 9B shows a schematic view of the layers forming the composite laminate used to make the backing of the product sampler in accordance with a preferred embodiment of the present invention.

Referring now to FIG. 9B, the backing film 220 preferably comprises a heat seal layer 221, a white polyethylene layer 223, a foil barrier layer 225, and a polyester exterior layer 227, and having a combined thickness of about 4.5–5.0 mils. Barrier layer 225 is preferably an aluminum foil film having a thickness at least about 0.20 mil (MVTR<0.01 g/100 $in^2$/24 hrs @100° F., 90% RH). As in cover film 230, heat seal layer 221 may be comprised of a high density/low density polyethylene blend or other suitable material. Similarly, additional layers may be included or suitable alternative materials may be substituted as described above.

The layers forming the composite laminate of backing film 220 are preferably adhesively laminated with adhesive layers 222 made from a material such as a polyurethane or other suitable adhesive. Alternatively, the layers of backing film 220 may be coextrusion laminated using tie layers made from materials such as ethylene vinyl acetate, ethylene methacrylate or ethylene vinyl alcohol.

In another embodiment of the present invention, the foil film may be substituted with a transparent or translucent barrier film as used in the cover film. In this embodiment, backing film 220 has a composition substantially similar to that of cover film 230, such that each layer is transparent or translucent. Backing film 220 may also contain a window design and/or copy print as described above with respect to cover film 230 which can viewable through transparent cover film 230 if the product contained therein is also transparent or translucent.

Cover film 230 and backing film 220 are sealed together to form pouch 211. In the embodiment in which both cover film 230 and backing film 220 include the transparent and translucent film as the barrier layers, the entire sampler can be made from one composite laminate by sealing the laminate to itself to form pouch 211. Although heat sealing is the preferred method of sealing, other sealing methods are also consistent with the present invention, such as dielectric sealing, radiant sealing, sonic sealing, high frequency sealing, etc.

In the process for forming the product sampler shown in FIG. 7, a roll of the transparent composite laminate 230 and a roll of the foil barrier composite laminate 220 are fed to a die which seals together the heat seal layers of each composite laminate in a shape which partially forms a plurality of sampler pouches 211 along a continuous strip of sampler units. This initial sealing process leaves a portion of each pouch unsealed, up to approximately one-half the perimeter of a finished pouch. The roll of partially heat-sealed pouches is then sent to the next processing stage, where each pouch is placed under a nozzle which fills the cosmetic sample into the pouch. When a plurality of different types or colors of cosmetic samples are to be provided in one strip of sampler packettes, as in the embodiment shown in FIG. 7, a plurality of nozzles are used so that each nozzle fills a different color or product type into the respective pouch.

When the sampler strips 200 are to be distributed in magazines, mailers, or the like sealed in the carrier card 100 as described above, each sampler unit measures about 2" by 1½" and is filled with a maximum of about 350 mg of the fluid or volatile cosmetic in each pouch. For alternative means of distribution, such as department store handouts of the sampler strips not necessarily accompanied by any brochures or carrier cards, more or less of the sample may be filled in each pouch and the size of the sampler unit may be increased or decreased without varying from the scope of the invention.

After filling, the unsealed perimeter of each pouch is sealed to form a continuous strip of sealed packettes. It is noted that the pouch shape includes an extended tip portion 215 for ease of dispensing the product once opened by the consumer. The roll of sealed sampler packettes is then perforated by die cutting through the sealed regions between the pouches along lines 213 for ease of separation of the individual units and perpendicularly thereto to form perforations 216 across the tip 215 of each pouch for ease of opening. The roll of sampler packettes is then cut to form strips of sampler packettes for distribution, with each strip having a single or a plurality of sampler pouches. For example, the embodiment shown in FIG. 7 shows a distribution unit having three sampler units per sampler strip.

As previously mentioned, biaxially oriented polyvinylidene chloride film (biax-PVDC) or polychlorotrifluoroethylene (PCTFE) film may be used as the moisture vapor barrier layer in at least the cover film according to one preferred embodiment of the present invention. The advantages provided by these films are demonstrated by the data shown in FIGS. 10 and 11, and in Tables I–V.

Figure 10:
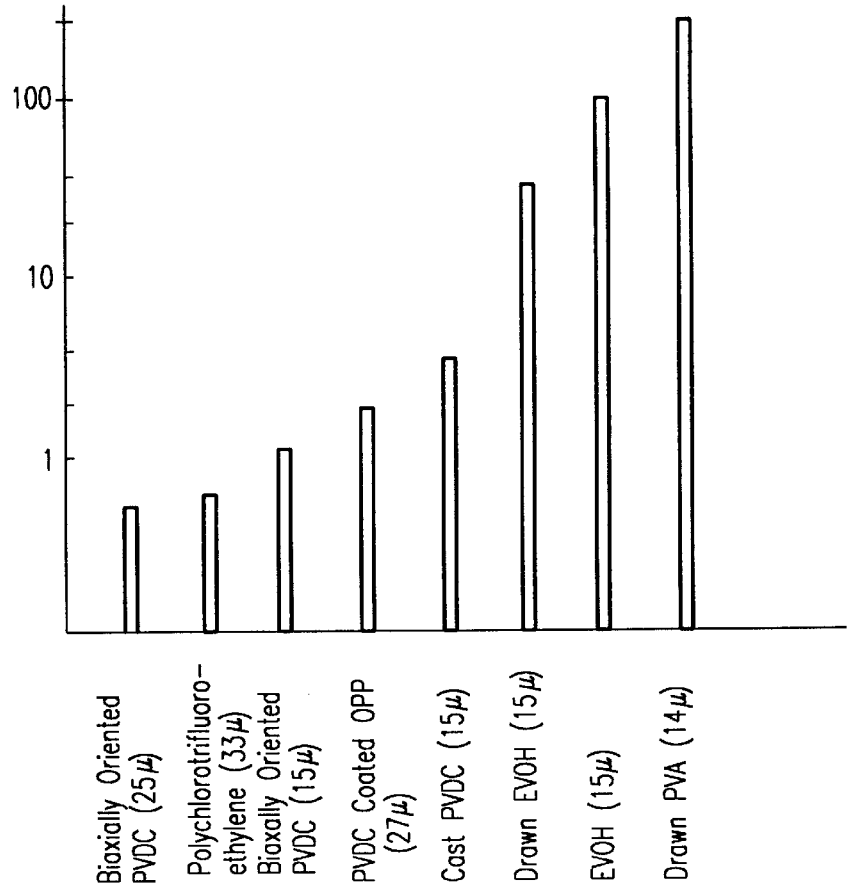
FIG. 10 is a graph which compares the moisture vapor permeability of various polymeric barrier films including the preferred barrier films to be used in the product sampler of the present invention.

FIG. 10 shows that the water vapor transmission rates of the biaxially oriented PVDC film and of the PCTFE film are much lower than typical films such as cast PVDC films and PVDC coated films used in the prior art. For example, a biax-PVDC film having a thickness of 0.6 mils (15$\mu$) has a water vapor transmission rate of about 0.065 g/100 in$^2$/24 hrs @100° F., 90% RH (1 g/m$^2$/24 hrs @40° C., 90% RH), whereas a PVDC coated oriented-polypropylene film of 1.1 mils (27$\mu$), nearly twice the thickness of the former, has a water vapor transmission rate of about 0.26 g/100 in$^2$/24 hrs @100° F., 90% RH (4 g/m$^2$/24 hrs @40° C., 90% RH). Similarly, a 1.3 mil (33$\mu$) PCTFE barrier film is shown to have an MVTR of about 0.05 g/100 in$^2$/24 hrs @100° F., 90% RH, which is substantially equivalent to that of the 1.0 biax-PVDC film.

Figure 11:
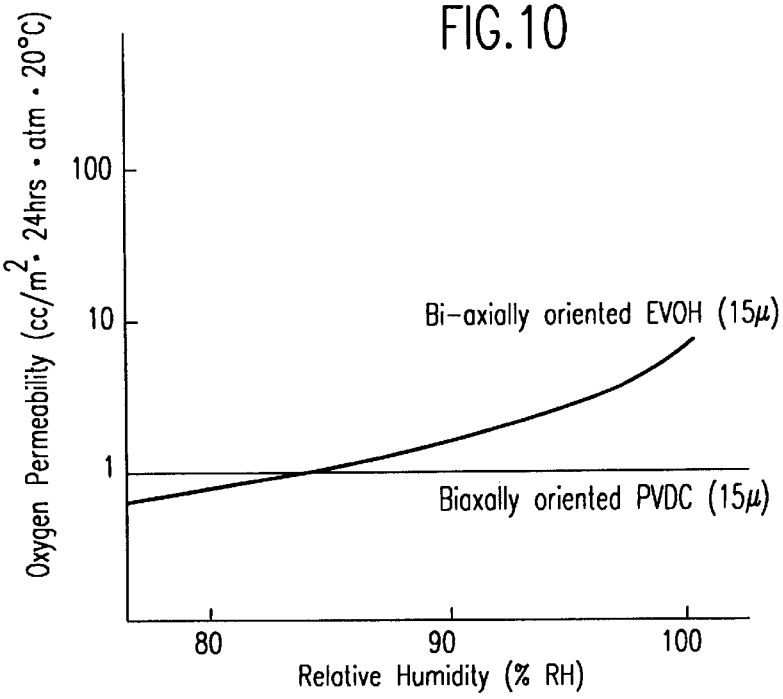
FIG. 11 is a graph which compares the dependency of oxygen permeability relative to relative humidity of a barrier film suitable for use in the present invention to that of another known type of barrier film.

The oxygen transmission rate of the 0.6 mil (15$\mu$) biax-PVDC film is shown in FIG. 5 relative to percent relative humidity. Specifically, FIG. 11 shows that the oxygen transmission rate is not affected by environmental humidity.

Table I demonstrates the relationship between the thickness of the film to the moisture vapor and oxygen transmission rates.

TABLE I

| Thickness | mil ($\mu$) | 0.6 (15) | 1.0 (25) | 2.0 (50) |
|---|---|---|---|---|
| Water Vapor Transmission Rate | g/100 in$^2$/24 hrs @ 100° F., 90% RH (g/m$^2$/24 hrs @ 38° C., 90% RH) | 0.065 (1.0) | 0.04 (0.6) | 0.02 (0.3) |
| Oxygen Transmission Rate | cc/100 in$^2$/24 hrs @ 73° F., atm (cc/m$^2$/24 hrs @ 23° C., atm) | 0.10 (1.4) | 0.06 (0.9) | 0.03 (0.5) |

Test results comparing the moisture vapor properties of several types of composite laminates using different barrier layers are shown below in Tables II–V. For each sample, a clear laminate incorporating the specified barrier layer was sealed to itself to form a pouch having the barrier laminate as the front and back thereof, i.e. single-web construction. Four sets of each type of barrier laminate packette were tested, with two sets of each type filled with water and the remaining sets filled with a liquid cosmetic product. Of the two sets of each sample type, one set was tested at 110° F. while the other set was tested at 120° F. The percentages of moisture loss by weight was obtained after one week and after two weeks.

TABLE II

Laminate of 0.7 mil PVDC Coating on Oriented Polypropylene (% Moisture Loss by Weight)

| | 110° F. | 120° F. | Product |
|---|---|---|---|
| 1 week | 2.16–2.36 | 2.42–2.70 | water |
| 2 weeks | 4.54–5.17 | 5.09–5.95 | water |
| 1 week | 1.95–2.44 | 2.74–4.12 | liquid cosmetic |
| 2 weeks | 5.02–5.45 | 5.34–6.3 | liquid cosmetic |

TABLE III

Laminate of 2.0 mil Aluminum Oxide (% Moisture Loss by Weight)

| | 110° F. | 120° F. | Product |
|---|---|---|---|
| 1 week | 2.1–2.94 | 2.04–4.15 | water |
| 2 weeks | 3.9–5.15 | 3.90–7.37 | water |
| 1 week | 2.24–3.49 | 2.27–3.63 | liquid cosmetic |
| 2 weeks | 4.0–6.18 | 4.06–6.48 | liquid cosmetic |

TABLE IV

Laminate of 1.0 mil Biaxially Oriented PVDC (% Moisture Loss by Weight)

| | 110° F. | 120° F. | Product |
|---|---|---|---|
| 1 week | 1.20–1.40 | 1.39–1.58 | water |
| 2 weeks | 2.25–2.74 | 3.0–3.45 | water |
| 1 week | 1.21–1.49 | 1.63–1.80 | liquid cosmetic |
| 2 weeks | 2.67–3.14 | 3.4–3.90 | liquid cosmetic |

TABLE V

Laminate of 1.3 mil Polychlorotrifluoroethylene Film (% Moisture Loss by Weight)

| | 110° F. | 120° F. | Product |
|---|---|---|---|
| 1 week | 1.15–1.62 | 1.25–1.85 | water |
| 2 weeks | 2.33–3.11 | 2.61–3.82 | water |
| 1 week | 0.61–0.76 | 0.66–0.88 | liquid cosmetic |
| 2 weeks | 1.25–1.47 | 1.38–1.86 | liquid cosmetic |

As can be seen from Table II, the moisture loss in the PVDC coated OPP laminate packages ranged from 4.5% to 5.5% of the original weight after two weeks at 110° F. This result is extrapolated to yield a moisture loss of over 12% after one year at room temperature. Similar results are demonstrated in Table III, wherein AlO was used as a barrier film.

In contrast, the moisture loss in the biaxially oriented PVDC barrier laminate packettes after two weeks at both test temperatures ranged from 2.25% to 3.9% of the original sample weight, as shown in Table IV. These results obtained after a test period of two weeks at 110° F. and 120° F. can be extrapolated to be equivalent to the moisture that would be lost over a period of 6–8 months at room temperature.

During testing, it was found that the moisture loss from a sample of a liquid cosmetic sealed in a single web of biax-PVDC laminate did not result in any adverse change in texture of the cosmetic when observed even after 10 months at room temperature. Thus, a single webbed sampler packette made from the biax-PVDC laminate easily provides a usable product sample for a minimum shelf life of six months.

Moreover, when the sampler packette is made with a foil laminate on one side, as discussed above with respect to the preferred embodiments of the present invention, the moisture loss ranged from 2.5% to 3.0% of the original sample weight for one month at 110° F. and 120° F. By extrapolation, this is the moisture loss that can be expected for a packette of this construction after a period of one year at room temperature.

Table V shows that the results obtained for the PCTFE laminate packettes are similar to the results obtained for the biax-PVDC packettes. Specifically, the moisture loss from the PCTFE laminate packettes after two weeks at 110° F. and 120° F. range from 1.25% to 3.82% of the original sample weight. Thus, the extrapolated shelf life at room temperature of the PCTFE laminated packettes is comparable to the biax-PVDC based packettes.

Due to the excellent gas and moisture vapor barrier properties of the sampler packette containing moisture vapor barrier films having an MVTR$\leqq$0.065 g/100 in$^2$/24 hrs @100° F., 90% RH as discussed above, samples of cosmetic products having a fluid base such as water or other organic solvent may be distributed in a manner which displays the shade of the cosmetic product to the consumer through the packette while maintaining the compositional integrity of the product for a much greater time period than previously obtained with cosmetic samplers previously used in the art.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A product sampler package comprising:

a sampler packette containing a product sample;

a main card section having a front surface and a back surface;

a cover section having a front surface and a back surface, the cover section being adhered to the front surface of the main card section to form a closed carrier card, the sampler packette disposed between the main card section and the cover section, the cover section including:

a window for exposing at least a portion of the sampler packette; and a removable portion for opening the carrier card to permit access to at least a portion of the sampler packette.

2. The product sampler package as recited in claim 1, wherein the cover section is an extension of the main card section and is folded over to cover at least a portion of the main card section along a fold line separating the main card and cover sections.

3. The product sampler package as recited in claim 2, wherein the fold line is perforated.

4. The product sampler package as recited in claim 1, wherein the removable portion comprises a zipper.

5. The product sampler package as recited in claim 4, wherein the zipper includes a pull tab and a strip defined by two parallel lines of perforations in the cover section.

6. The product sampler package as recited in claim 4, wherein the zipper includes a pull tab and a strip defined by two parallel lines of angled die-cuts formed in the cover section.

7. The product sampler package as recited in claim 4, wherein the zipper has a width such that when unzipped, a region under the cover section is exposed which is sufficiently large to uncover a portion of the sampler packette disposed between the main card and cover sections to permit opening of the sampler packette and sampling of the product contained therein.

8. The product sampler package as recited in claim 4, wherein the cover section includes a first region under which the sampler packette is disposed, the zipper being formed in the first region of the cover section, and a second region which does not cover the sampler packette.

9. The product sampler package as recited in claim 8, wherein the first region of the cover section is permanently sealed to the main card section.

10. The product sampler package as recited in claim 9, wherein the first region is sealed to the main card section by an adhesive pattern applied substantially around the perimeter of the back surface of the first region, but wherein the back surface of the zipper is adhesive-free.

11. The product sampler package as recited in claim 9, wherein the second region of the cover section is temporarily sealed to the main card section so as to be removable therefrom.

12. The product sampler package as recited in claim 11, wherein the second region is sealed to the main card section by a light adhesive applied in a dot pattern around the perimeter of the second region on the back surface of the cover section.

13. The product sampler package as recited in claim 8, wherein the first and second regions of the cover section are separated by a die-cut line which renders the second region detachable from the first region for removal from the carrier card.

14. The product sampler package as recited in claim 8, wherein the second region of the cover section comprises a coupon having copy print printed on at least one surface thereof.

15. The product sampler package as recited in claim 4, wherein the sampler packette has an openable region at which the package is designed to be opened to access the product contained therein, and wherein the zipper has a width such that when unzipped, the openable region of the sampler packette is exposed so that opening of the sampler packette can be performed.

16. The product sampler package as recited in claim 1, wherein the main card section includes a die-cut line extending across the width of the main card section so as to create a margin region which can be bound within a periodical and by which the product sampler package can be separated from the periodical by tearing therealong.

17. The product sampler package as recited in claim 1, wherein at least one of the main card section and the cover section are made from paperboard.

18. The product sampler package as recited in claim 1, wherein the product sampler has a transparent or translucent window aligned with a corresponding window so that a product contained in the sampler packette can be viewed through the product sampler package.

19. The product sampler package as recited in claim 1, further including marketing, advertising, or instructional material copy printed onto exposed portions of the front and back surfaces of each of the main card section and the cover section.

20. The product sampler package as recited in claim 1, wherein the sampler packette comprises a strip of product sampler units each capable of containing a sample dose of a fluid product.

21. The product sampler package as recited in claim 20, wherein each product sampler unit includes a pouch formed from two laminate films sealed around the shape of the pouch.

22. The product sampler package as recited in claim 21, wherein each pouch includes a tip at which the product sampler unit is to be opened.

23. The product sampler package as recited in claim 21, wherein each pouch is perforated along a top portion thereof to facilitate opening of the sampler unit.

24. The product sampler package as recited in claim 21, wherein the sampler strip is perforated between adjacent pouches so that a region to be opened in each sampler unit may be isolated prior to opening a selected sampler unit.

25. The product sampler package as recited in claim 20, wherein the product sample units of the sampler strip contain product samples which are mutually different in color, texture, or product type, and wherein each product sampler unit includes a transparent or translucent window aligned with a respective cutout window so that the respective product contained in each sampler unit may be viewed through the sealed product sampler package.

26. The product sampler package as recited in claim 1, wherein the sampler packette is formed from a transparent or translucent cover laminate including a transparent or translucent barrier film having a moisture vapor transmission rate substantially equivalent to that of a foil barrier film.

* * * * *